US009090099B2

(12) United States Patent
Ogasawara

(10) Patent No.: US 9,090,099 B2
(45) Date of Patent: Jul. 28, 2015

(54) INKJET PRINTING APPARATUS

(71) Applicant: CANON KABUSHIKI KAISHA, Tokyo (JP)

(72) Inventor: Seiji Ogasawara, Machida (JP)

(73) Assignee: Canon Kabushiki Kaisha, Tokyo (JP)

( * ) Notice: Subject to any disclaimer, the term of this patent is extended or adjusted under 35 U.S.C. 154(b) by 72 days.

(21) Appl. No.: 13/869,487

(22) Filed: Apr. 24, 2013

(65) Prior Publication Data

US 2013/0300795 A1 Nov. 14, 2013

(30) Foreign Application Priority Data

May 8, 2012 (JP) ..... 2012-106982

(51) Int. Cl.

| | |
|---|---|
| ***B41J 23/00*** | (2006.01) |
| ***B41J 11/00*** | (2006.01) |
| ***B41J 2/045*** | (2006.01) |
| ***B41J 25/308*** | (2006.01) |

(52) U.S. Cl.

CPC ..... *B41J 11/00* (2013.01); *B41J 2/04556* (2013.01); *B41J 25/3082* (2013.01)

(58) Field of Classification Search

CPC ..... B41J 25/304; B41J 25/308; B41J 25/312; B41J 25/3082; B41J 25/3088; B41J 2/14; B41J 2/1404; B41J 2/04556; B41J 2/04558; B41J 2/04561

See application file for complete search history.

(56) References Cited

U.S. PATENT DOCUMENTS

| | | | | |
|---|---|---|---|---|
| 7,284,814 | B2 | 10/2007 | Ogasawara | |
| 8,079,659 | B2 | 12/2011 | Tajika et al. | |
| 2009/0058895 | A1* | 3/2009 | Kida | 347/8 |

FOREIGN PATENT DOCUMENTS

| | | | |
|---|---|---|---|
| JP | 2008-260170 | A | 10/2008 |

* cited by examiner

*Primary Examiner* — Geoffrey Mruk

(74) *Attorney, Agent, or Firm* — Fitzpatrick, Cella, Harper & Scinto

(57) ABSTRACT

There is provided an inkjet printing apparatus which, even in a case where a landing position of ink changes due to a change in a distance between an ejection port of a print head and a support surface of a print medium, the print medium is conveyed by an appropriate conveyance amount. The inkjet printing apparatus detects a changing amount of the landing position of an ink droplet. The conveyance amount of the print medium by a conveying roller and a pinch roller is controlled based upon the detected changing amount.

10 Claims, 9 Drawing Sheets

| KIND OF PRINT MEDIUM | HEAD-MEDIUM DISTANCE | | | |
|---|---|---|---|---|
| | A | B | C | D |
| PRINT MEDIUM 1 | 2AtanY | - | 2CtanY | - |
| PRINT MEDIUM 2 | 2AtanY | - | 2CtanY | - |
| PRINT MEDIUM 3 | - | 2BtanY | 2C'tanY | - |
| PRINT MEDIUM 4 | - | 2BtanY | 2C'tanY | - |
| PRINT MEDIUM 5 | - | - | 2C"tanY | - |
| PRINT MEDIUM 6 | - | - | - | 2DtanY |

FIG.7A

| KIND OF PRINT MEDIUM | HEAD-MEDIUM DISTANCE | | | |
|---|---|---|---|---|
| | A | B | C | D |
| PRINT MEDIUM 1 | 2AtanY | - | 2CtanY | - |
| PRINT MEDIUM 2 | 2AtanY | - | 2CtanY | - |
| PRINT MEDIUM 3 | - | 2BtanY | 2BtanY | - |
| PRINT MEDIUM 4 | - | 2BtanY | 2BtanY | - |
| PRINT MEDIUM 5 | - | - | 2C"tanY | - |
| PRINT MEDIUM 6 | - | - | - | 2DtanY |

FIG.7B

INKJET PRINTING APPARATUS

BACKGROUND OF THE INVENTION

1. Field of the Invention

The present invention relates to an inkjet printing apparatus which adjusts a conveyance amount of a print medium corresponding to a change in a landing position of an ink droplet generated by a change of a distance between a print head and the print medium.

2. Description of the Related Art

There is proposed an inkjet printing apparatus which performs conveying control of a print medium for performing printing of high image quality on the print medium. For example, in Japanese Patent Laid-Open No. 2008-260170, it is disclosed that a conveyance error of the print medium due to eccentricity of a conveying roller or a variation of a conveyance amount existing for each rotational angle of the conveying roller is corrected. Then the conveyance of the print medium is performed by the corrected conveyance. In the inkjet printing apparatus disclosed in Japanese Patent Laid-Open No. 2008-260170, a test pattern is printed on a print medium, and then is in advance scanned, thereby correcting the conveyance amount of the print medium.

However, there are some cases of adopting an inkjet printing apparatus in which as a distance between the print head and a support surface supporting the print medium changes, a landing position of an ink droplet changes following the change of the distance. In this case, there is a possibility that even if only the conveyance error of the print medium due to eccentricity of the conveying roller or the variation of the conveyance amount existing for each rotational angle of the conveying roller is corrected, it is insufficient for the adjustment of the conveyance amount. Therefore there occurs a possibility of being incapable of performing the printing with an appropriate conveyance amount. In a case where the conveyance is not performed appropriately, there is a possibility that a clearance occurs between images printed by the respective scans, and thereby a white stripe is generated in the image. In addition, when the images printed by the respective scans excessively largely overlap with each other, in some cases there is generated a black stripe in the image. Therefore there is a possibility that a quality of a print image is degraded.

SUMMARY OF THE INVENTION

Therefore the present invention is made in view of the foregoing problems, and an object of the present invention is to provide an inkjet printing apparatus which, even in a case where a landing position of ink changes due to a change in a distance between an ejection port of a print head and a support surface of a print medium, the print medium is conveyed by an appropriate conveyance amount.

According to an aspect of the present invention, there is provided an inkjet printing apparatus comprising: a carriage which is capable of mounting a print head being capable of ejecting ink droplets from an ejection port; a conveying unit configured to perform conveyance of a print medium; a support surface for supporting the print medium conveyed by the conveying unit; an adjusting unit which is capable of adjusting a distance between an ejection port forming portion in which the ejection port is formed and the support surface; a detecting unit configured to detect a changing amount of a landing position of the ink droplet; and a control unit configured to control a conveyance amount of the print medium by the conveying unit based upon the changing amount of the landing position of the ink droplet detected by the detecting unit.

According to the present invention, since the conveyance amount of the print medium can be appropriately set, generation of the white stripe or the black stripe in a print image can be suppressed. Therefore the quality of the print image obtained by the printing can be highly maintained.

Further features of the present invention will become apparent from the following description of exemplary embodiments (with reference to the attached drawings).

BRIEF DESCRIPTION OF THE DRAWINGS

FIG. 7A and FIG. 7B are tables each showing, at the time of changing the head-medium distance between the ejection port forming portion in the print head in FIG. 6 and the print medium, and a kind of the print medium, a corrective amount for correcting the conveyance of the print medium in each case;

DESCRIPTION OF THE EMBODIMENTS

First Embodiment

Figure 1:
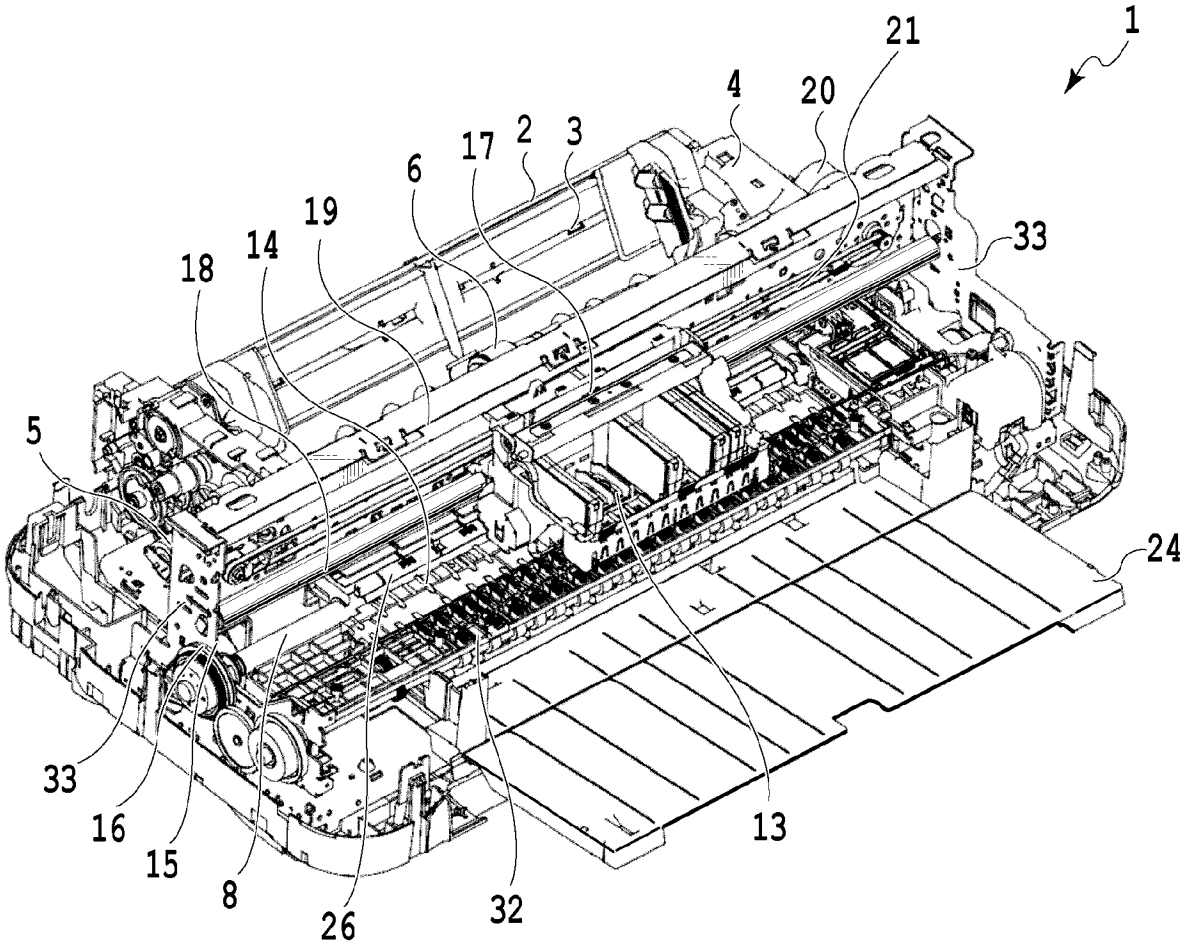
FIG. 1 is a perspective view showing an inkjet printing apparatus according to a first embodiment of the present invention, in which an upper cover is removed for showing an internal configuration of the inkjet printing apparatus.
Figure 2:
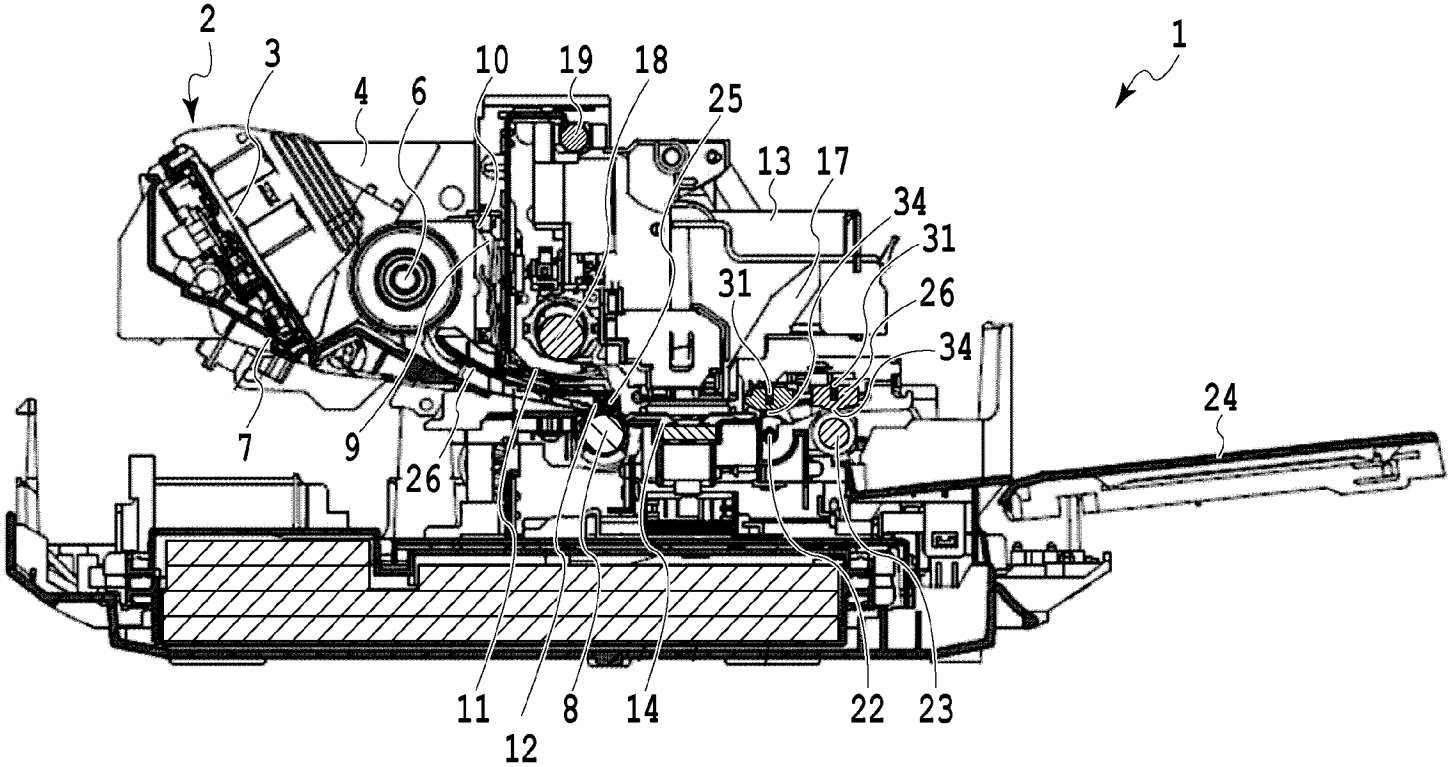
FIG. 2 is a cross sectional view showing the inkjet printing apparatus in FIG. 1 as viewed from a side surface.

Hereinafter, an inkjet printing apparatus according to a first embodiment in the present invention will be explained. An outline of the entire inkjet printing apparatus will be explained. FIG. 1 is a perspective view showing the inkjet printing apparatus 1 according to the first embodiment, in which an upper cover is removed for showing an internal configuration thereof. FIG. 2 is a cross sectional view showing the inkjet printing apparatus 1 shown in FIG. 1 as viewed from a side surface.

The inkjet printing apparatus 1 is provided with a paper feeding component 2 and a paper-feeding component frame body 4. A print medium, on which printing is perform, is stacked on the paper feeding component 2. The print medium stacked on the paper feeding component 2 is conveyed from the paper feeding component 2 toward a print head 13, and the printing is performed thereon. The paper feeding component 2 is provided with pressure plates 3. The pressure plate 3 is mounted to the paper-feeding component frame body 4 such that an angle of the pressure plate 3 can change for changing an inclined angle of the print medium stacked. A paper feeding roller 6 and a paper feeding motor 5 as a driving source for driving the paper feeding roller 6 are mounted on the paper feeding component 2.

In addition, the inkjet printing apparatus 1 is provided with a conveying roller 8 and a pinch roller 12 as conveying units for carrying out conveyance of the print medium. The conveying roller 8 is rotatably mounted to a frame 33 at the body side in the inkjet printing apparatus 1. The conveying roller 8 is connected to a conveying motor 15, which is a driving source, through a timing belt 16 for the conveying roller. The conveying roller 8 is driven with a rotational drive of the conveying motor 15 for rotation. The pinch roller 12 is urged toward a direction of the conveying roller 8 by a pinch roller spring 11 through a pinch roller shaft 25 and a pinch roller holder 26. The pinch roller 12 is urged toward the conveying roller 8 to be pressed thereto, and is mounted to be rotatable with the rotation of the conveying roller 8. When the conveying roller 8 is driven for rotation in a state where the conveying roller 8 and the pinch roller 12 sandwich the print medium therebetween, the print medium is conveyed along a conveyance direction.

In addition, a platen 14 is formed in the inkjet printing apparatus 1 for supporting the print medium in a position opposing the print head 13. The inkjet printing apparatus 1 is provided with a carriage 17 capable of mounting the print head 13 and an ink tank.

Figure 5:
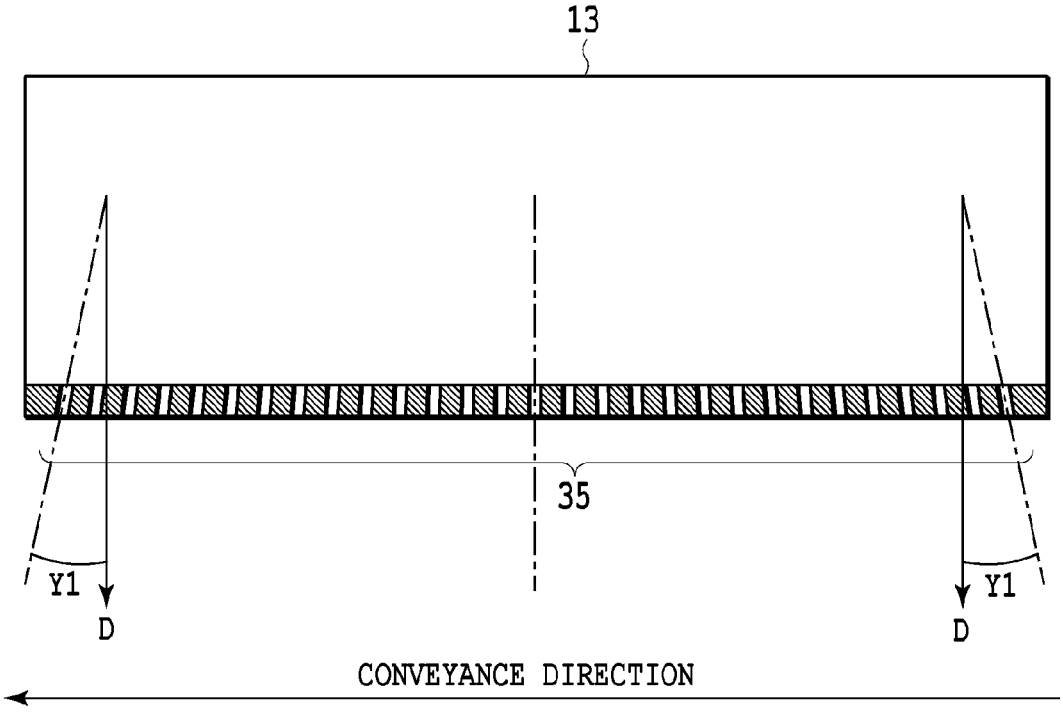
FIG. 5 is a schematically cross sectional view showing a print head used in the inkjet printing apparatus in FIG. 1.

The print head 13 has a surface opposing the print medium, the surface being provided with ejection ports, as shown in FIG. 5. The print head 13 can eject an ink droplet from the ejection port. Ink supply ports and a plurality of flow passages extending from the ink supply ports are formed in the print head 13. Each flow passage is formed to be communicated with the ejection port. The ink from the ink tank is supplied to the ink supply port in the print head 13, and then is supplied through the ink supply port to each flow passage. The ink in the print head 13 is stably held by forming meniscuses in the ejection port. In addition, a heater element (electrothermal transducing element) is provided in each ink flow passage in a position corresponding to the ejection port. The heater element is energized to generate thermal energy from the heater element, thus heating the ink in the ink flow passage. This heating causes film boiling to be generated in the ink for bubble generating, and the ink droplet is ejected from the ejection port by the bubble generating energy at this time.

It should be noted that the print head in the present embodiment adopts a system in which the film boiling is generated by the heater element for bubble generating, thus ejecting the ink droplet, but the present invention is not limited thereto. A print head in the form of deforming a piezoelectric element to eject liquids inside the print head may be applied to the printing apparatus. In addition, another form of a print head may be applied to the printing apparatus according to the present invention.

The inkjet printing apparatus 1 is provided with a guide shaft 18 extending along a main scan direction crossing the conveyance direction of the print medium. The inkjet printing apparatus 1 is a printing apparatus of a serial scan system, and the carriage 17 slides on the guide shaft 18, which guides the movement of the carriage 17 in the main scan direction. Therefore the carriage 17 is configured to be movable along the guide shaft 18. The carriage 17 reciprocates in the main scan direction by a carriage motor and a driving force transmission mechanism for transmitting the driving force, such as a belt.

Figure 3:
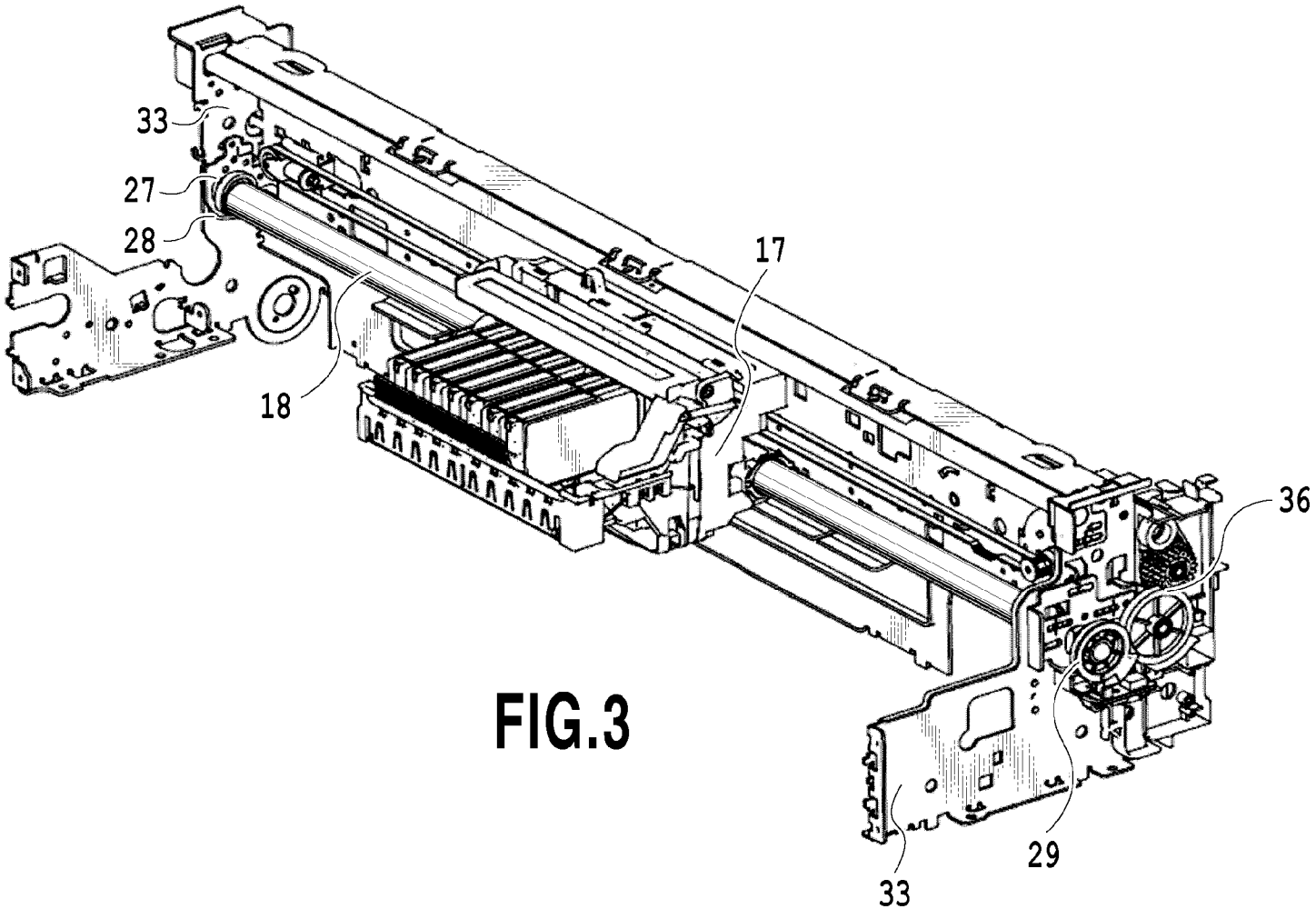
FIG. 3 is a perspective view showing a scanning mechanism for a scan of a carriage in the inkjet printing apparatus in FIG. 1.

As shown in FIG. 3, the carriage 17 is supported by the guide shaft 18 and a guide rail 19 to be capable of scanning. FIG. 3 is a perspective view showing the carriage 17 and a scanning mechanism causing the carriage 17 to scan, which are taken out of the inkjet printing apparatus 1. The carriage 17 is driven through a carriage timing belt 21 by a drive of a carriage motor 20. In a state where the print head 13 and the ink tank are mounted on the carriage 17, the carriage 17 reciprocates in the main scan direction crossing the conveyance direction of conveying the print medium and ink droplets are ejected from the print head 13, thus performing the printing on the print medium.

Figure 8:
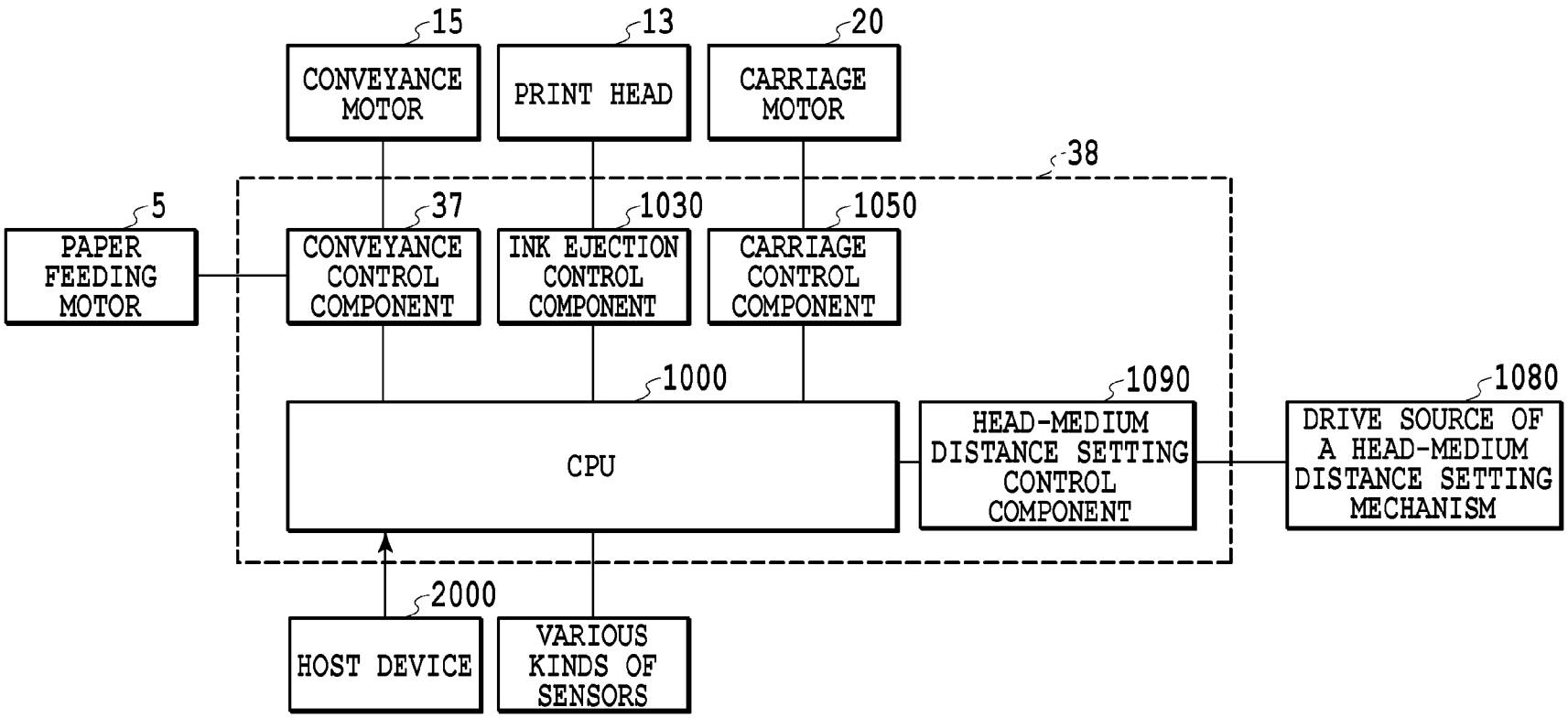
FIG. 8 is a block diagram showing a control system in the inkjet printing apparatus in FIG. 1.

FIG. 8 is a block configuration diagram of a control system in the inkjet printing apparatus according to the present embodiment. A CPU 1000 performs control processing, data processing and the like of various kinds of operations in response to input from a host device 2000. Ejection of ink from the print head 13 is performed by supplying drive data (image data) and a drive control signal for driving a print element, to an ink ejection control component 1030 by the CPU 1000. The CPU 1000 controls a carriage motor 20 for driving the carriage in the main scan direction through a carriage control component 1050. In addition, the CPU 1000 controls the conveying motor 15 for conveying the print medium through a conveyance control component 37. Further, the CPU 1000 controls a head-medium distance setting mechanism drive source 1080 of for setting a head-medium distance through a head-medium distance setting control component 1090.

At the time the print medium is fed, the pressure plate 3 rotates toward the paper feeding roller 6 by the pressure plate spring 7, and the paper feeding roller 6 is driven and rotated by the paper feeding motor 5. Therefore the print medium is pressed to the paper feeding roller 6 in a state of being sandwiched. When the paper feeding rollers 6 rotate in that state, only a print medium on the uppermost surface is separated out of the stacked print mediums, and is fed to the downstream side.

The print medium separated and fed by the paper feeding component 2 is conveyed to the conveying roller 8 with further rotation of the paper feeding roller 6. Here, a front end of the print medium fed by the paper feeding component 2 pushes a sensor lever 9 arranged between the paper feeding roller 6 and the conveying roller 8, thereby rotating the sensor lever 9. Further, when the sensor lever 9 is removed out of a seat sensor 10, the front end of the conveyed print medium is detected. In addition, a rear end of the print medium is detected with insert of the sensor lever 9 into the seat sensor 10. In addition, the print medium is conveyed by a predetermined amount by the paper feeding roller 6 based upon the detection result of the front end of the print medium, and bumps into a conveying roller nip formed by contact between the conveying roller 8 and the pinch roller 12. When the print medium is further conveyed by the paper feeding roller 6, a front end portion thereof is curved and is pressed on the conveying roller nip, thus completing a front end lining-up operation. After the front end lining-up operation, the print medium is conveyed on the platen 14 by the conveying roller 8, and is held on an upper surface of the platen 14.

When the print medium is supported on the platen 14, ink droplets are ejected on the print medium from the print head 13 following the scan of the carriage 17, thereby performing the printing.

In the present embodiment, the carriage 17 scans in the main scan direction while the print head ejects ink droplets on the print medium, thus completing the printing corresponding to a single scan. Then the conveyance of the print medium is performed by a conveyance amount of a predetermined length corresponding to the number of times of scans performed for performing the printing in a predetermined print region. At this time, the control, which will be described later, in regard to the conveyance amount of the print medium is performed, and the conveyance of the print medium is performed. This print operation and conveying operation are repeated until the printing of the print image is completed.

The print medium on which the printing is completed is discharged on a discharge tray 24 by an upstream discharge roller 22, a downstream discharge roller 23 and a spur 34 urged toward the downstream discharge roller 23 and the upstream discharge roller 22. The spur 34 is rotatably supported to a spur holder 32 by a spur spring 31 formed of a bar-like coil spring.

Figure 4:
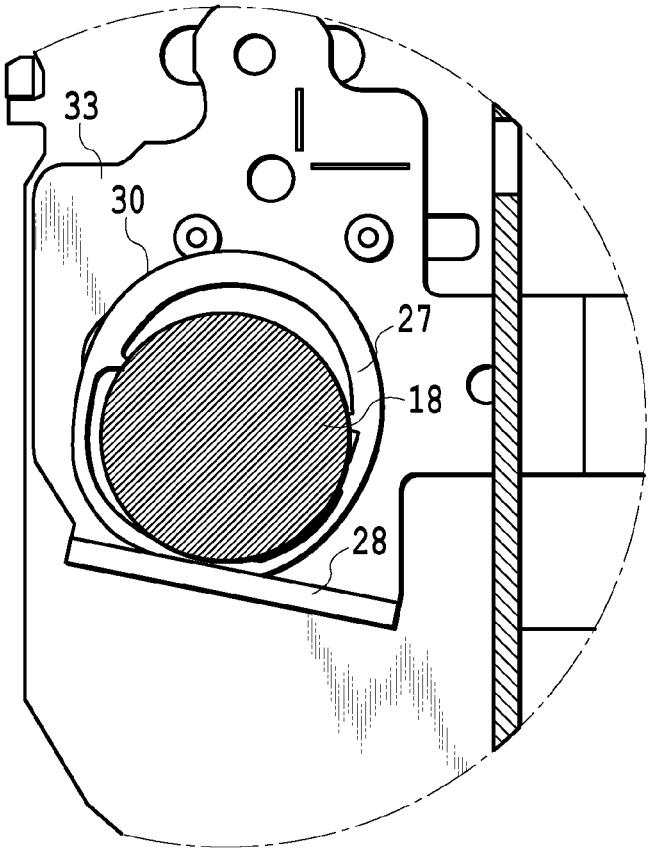
FIG. 4 is an enlarged cross sectional view showing the surroundings of an end portion in a guide shaft in the inkjet printing apparatus in FIG. 1.

In addition, the inkjet printing apparatus 1 is provided with a setting mechanism of setting a head-medium distance in such a manner that the head-medium distance as a distance between an ejection port forming portion in which the ejection port is formed in the print head 13 and the print medium can be changed. Here, the setting mechanism of the head-medium distance will be explained. FIG. 4 is an enlarged cross sectional view showing the guide shaft 18, a head-medium distance setting cam 27 mounted in an end portion of the guide shaft 18, and a cam receiving surface 28. In the present embodiment, the head-medium distance setting cams 27 are mounted to both end portions of the guide shaft 18.

The head-medium distance setting cam 27 is mounted in such a manner that the guide shaft 18 is inserted into the inside and penetrates therein. In addition, the head-medium distance setting cam 27 is mounted in a fixed way on the outer periphery of the guide shaft 18 in such a manner as not to move relatively to the guide shaft 18. The head-medium distance setting cam 27 has an outer peripheral surface provided with a cam face 30 in which a distance from a rotational center of the guide shaft 18 to a contact surface between the head-medium distance setting cam 27 and the cam receiving surface 28 differs depending upon a position thereof. The cam receiving surface supporting the head-medium distance setting cam 27 is provided in a position corresponding to the head-medium distance setting cam 27 in a frame 33 of the body side in the inkjet printing apparatus 1. The outer peripheral surface of the head-medium distance setting cam 27 is placed on the cam receiving surface 28 provided in the frame 33.

In addition, a gear 29 is mounted on an outer periphery of the guide shaft 18 at one end portion thereof to be fixed thereto. Therefore when a rotation driving force is transmitted to the gear 29, the guide shaft 18 is also rotated together with the gear 29, and the head-medium distance setting cam 27 mounted on the guide shaft 18 is also rotated together. The guide shaft 18, the head-medium distance setting cam 27, and the gear 29 are formed to be coaxial with each other.

The gear 29 is rotated with transmission of the rotation driving force to the gear 29 through a gear train 36 from a drive source (drive source of the head-medium distance setting mechanism) (not shown). Thereby the guide shaft 18 and the head-medium distance setting cam 27 rotate together with the gear 29. The guide shaft 18 is urged toward the cam receiving surface 28. Accordingly by rotating the head-medium distance setting cam 27, the head-medium distance setting cam 27 and the cam receiving surface 28 make contact with each other, while it is possible to change the distance between the rotational shaft of the guide shaft 18 and the cam receiving surface 28 provided in the frame 33. Therefore the distance between the guide shaft 18 and the support surface in the platen 14 in the body side of the printing apparatus changes. In addition, since the guide shaft 18 moves relative to the support surface of the platen 14, the carriage 17 and the print head 13 mounted on the carriage 17 move relatively to the support surface of the platen 14.

Since the head-medium distance setting cam 27 is thus mounted on the guide shaft 18, the carriage 17 and the print head 13 supported by the guide shaft 18 are movable in an approaching/leaving direction to the print medium supported by the platen 14 while maintaining a parallel state to the print medium. In addition, when the rotation driving source of the guide shaft 18 is stopped at timing a desired cam face 30 of the head-medium distance setting cam 27 makes contact with the cam receiving surface 28, the head-medium distance is set to a desired distance. In regard to the timing of setting the head-medium distance, it is generally completed before separation feeding of the print medium by the paper feeding device 2 is performed.

In this way, the inkjet printing apparatus 1 according to the present embodiment is configured to be capable of adjusting the distance between the ejection port forming portion in which the ejection port is formed in the print head 13 and the support surface of the platen 14. Therefore the adjustment of the head-medium distance between the ejection port forming portion in the print head 13 and the print medium is performed by adjusting the distance between the ejection port forming portion and the support surface in the platen 14. In the present embodiment, the CPU 1000 functions as an adjusting unit for adjusting the distance between the ejection port forming portion and the support surface in the platen 14.

Next, control of a conveyance amount of the print medium in the present embodiment will be explained.

As the carriage 17 scans while ejecting ink droplets from the print head 13 to complete printing of the first line, the conveyance of the print medium is carried out by the conveying roller 8 for a line feed operation. In the present embodiment, the conveyance amount at the time of the conveyance of the print medium performed between printing operations to the respective lines is controlled. Here, the control of the conveyance amount of the print medium will be explained by referring to an example of one-path printing in which the printing to a predetermined print region is completed by a single scan of the carriage 17.

FIG. 5 is a schematically cross sectional view showing an ejection port array formed in the print head 13 used in the inkjet printing apparatus 1 according to the present embodiment. FIG. 5 is the view showing the print head 13 as viewed from a side face, and shows a section of the ejection port array within a plane along the conveyance direction. Depending on a manufacturing method of the print head, as shown in FIG. 5, a part of ejection ports is formed to be inclined in the print head.

In the prim head 13 of the present embodiment, at least a part of the ejection ports ejects ink droplets in a direction inclined from a direction perpendicular to the support surface of the platen 14. In the present embodiment, particularly the ejection port array provided with plural ejection ports formed along the conveyance direction of the print medium is formed in the print head 13. In the prim head 13, the ejection ports formed near the center portion of the ejection port array along the conveyance direction of the print medium extend in a direction substantially perpendicular to the print medium and the support surface of the platen 14. In addition, as the position of the ejection port is closer to the outside of the ejection port array, the ejection port is formed to be inclined gradually largely in such a manner as to eject the ink droplet toward the outside. Among the ejection ports forming the ejection port array, the ejection port formed in a position closer to the center portion along the conveyance direction of the print medium ejects the ink droplet in a direction the closer to a direction D (FIG. 5) perpendicular to the support surface of the platen 14 through the ejection ports. Further, among the ejection ports forming the ejection port array, the ejection port formed in a position closer to the outside end portion of the ejection port array along the conveyance direction of the print medium ejects the ink droplet in a direction more largely inclined from the direction D perpendicular to the support surface of the platen 14. In the present embodiment, since the ejection port positioned near the end portion in the ejection port array is formed to be inclined from the direction perpendicular to the support surface, the direction of ejecting the ink droplet is inclined from the direction D perpendicular to the support surface of the platen 14.

Here, among the ejection ports forming the ejection port array, the ink droplet to be ejected from the ejection port formed in the outside end portion of the ejection port array in the conveyance direction is ejected in a direction having an inclination angle (first inclination angle) Y1 from the direction D perpendicular to the support surface. This indicates that the ejection port in the center portion of the ejection port array in the conveyance direction extends perpendicularly to the support surface of the platen 14 for supporting the print medium, and on the other hand, the ejection port formed in the outermost side of the ejection port array in the conveyance direction extends to be inclined at Y1 degrees to the support surface of the platen 14.

Figure 6:
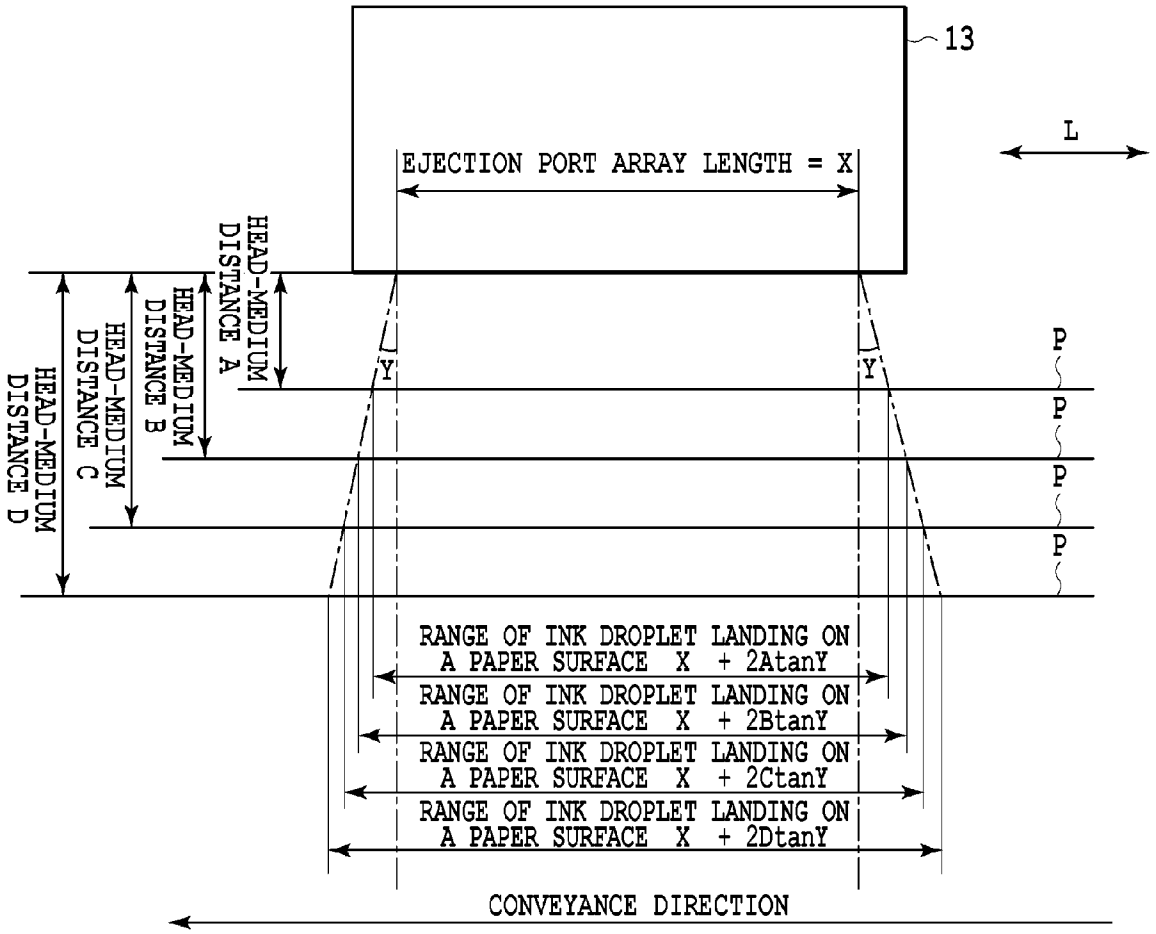
FIG. 6 is an explanatory diagram for explaining a relation between a distance between an ejection port forming portion in the print head in FIG. 5 and a print medium, and a landing range of an ink droplet ejected from the print head.

FIG. 6 shows a range in which an ink droplet ejected from the print head 13 having such an ejection port array lands on a print medium P. The range in which the ink droplet ejected from the ejection port array lands on the print medium P along the conveyance direction L of the print medium P is shown in relation to a length X of the ejection port array along the conveyance direction L of the print medium P. In addition, FIG. 6 shows a range in which, in regard to a plurality of different head-medium distances, an ink droplet lands on the print medium P along the conveyance direction L thereof in each of the head-medium distances.

In FIG. 6, for explanation, there is used an example of changing a position of the print medium P corresponding to the different head-medium distance. However, in an actual inkjet printing apparatus, the print head 13 moves in an approaching/leaving direction to the print medium P by the setting mechanism of the head-medium distance with no change in the position of the print medium P.

First, an explanation will be made of a case in which printing is performed on a print medium in the position of the smallest head-medium distance for achieving high image quality of a photo or the like. The print medium P used in this case is defined as a print medium 1 in a table shown in FIG. 7A. In addition, a head-medium distance between an ejection port forming portion in the print head 13 and the print medium is defined as A.

In a case where the ejection port formed in the print head is not inclined, an ink droplet is ejected toward the print medium P in a direction perpendicular to the support surface of the platen 14 and the print medium P from the ejection port. Therefore when the ink droplet is ejected from the ejection port array of the length X along the conveyance direction, the ink droplet lands on the print medium P within a range of the length X along the conveyance direction.

On the other hand, in a case where the ejection port is formed with an inclination of Y1 degrees, a range in which an ink droplet lands on the print medium P is longer by 2 A tan Y1 than the length X of the ejection port array along the conveyance direction. An ink droplet to be ejected from the ejection port in the outside end portion at one end of the ejection port array is ejected with an inclination of an angle of Y1 degrees from a direction perpendicular to the support surface of the platen 14. Therefore at one end of the ejection port array, the ink droplet to be ejected from the ejection port of the outside end portion in the ejection port array lands on a position shifted to the outside by A tan Y1 from a range of the length X of the ejection port array along the conveyance direction. In addition, in the print head 13 of the present embodiment, the ejection port array is formed to be symmetrical between the upstream and the downstream in the conveyance direction. Therefore the ink droplets to be ejected from the ejection port in the outside end portion land respectively on positions shifted in the reverse direction from the length X of the ejection port array along the conveyance direction at both of the upstream end portion and the downstream end portion of the ejection port array in the conveyance direction. Accordingly in the print head such that the ejection ports are inclined at both of the upstream side and the downstream side in the conveyance direction, as the print head 13, the ink droplet is shifted to the outside from the length X of the ejection port array at each of the end portions. Therefore the landing range of the ink droplet to be ejected from the print head 13 in the present embodiment extends to be longer along the conveyance direction by a length twice the length A tan Y1 than the range of the length X of the ejection port array.

Therefore the conveyance of the print medium is controlled in such a manner as to perform the conveyance of the print medium by a conveyance amount (first corrective conveyance amount) corrected by adding twice a value obtained by multiplying a distance between the ejection port forming portion and the support surface by a tangent of an inclination angle Y1, to the length X of the ejection port array in the conveyance direction. That is, as the length of the ejection port array in the conveyance direction is indicated at X, the distance between the ejection port forming portion of the print head 13 and the support surface of the platen 14 is indicated at L, and the corrected conveyance amount is indicated at H1, $H1=X+(2\times L\times \tan Y1)$.

In the present embodiment, the changing amount of the landing position of the ink droplet is thus detected. In the present embodiment, the CPU 1000 functions as a detecting unit for detecting the changing amount of the landing position of the ink droplet. In the present embodiment, particularly the changing amount of the landing position of the ink droplet changing with the distance between the ejection port forming portion of the print head 13 and the support surface, supporting the print medium, of the platen 14 is detected. At the time of detecting the changing amount of the landing position of the ink droplet, the inclination angle Y1 of the inclined ejection port in the outside end portion of the ejection port array may be in advance detected, and the corrective amount of the conveyance may be calculated from the inclination angle Y1 and the distance between the ejection port forming portion of the print head 13 and the support surface of the platen 14. In addition, a test regarding the landing position of the ink droplet may be performed for each time the printing operation is performed, and the changing amount of the landing position of the ink droplet obtained in the test may be detected.

In the present embodiment, the print medium P is conveyed with the conveying roller 8 by the amount obtained by adding the conveyance amount 2A tan Y1 to the length X of the ejection port array, as a line feed operation after the printing of the first line is completed. Since the ejection port formed near the outside end portion in the ejection port array is formed to be inclined, when the landing range of the ink droplet extends toward the outside of the length X of the ejection port array along the conveyance direction, the conveyance amount is corrected by the extended landing range. In the present embodiment, the conveyance is corrected by adding the conveyance amount corresponding to 2A tan Y1 of the extended landing range in the conveyance direction, to the length X of the ejection port array along the conveyance direction. In this way, the conveyance amount of the print medium P by the conveying roller 8 and the pinch roller 12 is controlled based upon the changing amount of the landing position of the ink droplet detected. In the present embodiment, the CPU 1000 functions as a control unit for performing the control of the conveyance amount.

Continuously the carriage 17 scans while ejecting ink droplets, thus completing the printing of the second line. After that, the print medium P is again conveyed by X+2A tan Y1 by the conveying roller 8. The printing operation and the conveying operation are repeated to perform the printing of all the print images, thus completing the printing process.

Since the correction of the conveyance amount is thus made, even if the landing range of the ink droplet on the print medium changes with the change of the head-medium distance, the conveyance of the print medium can be performed based upon the conveyance amount suitable for the head-medium distance of each corresponding to the change of the landing range of the ink droplet. As a result, it can be suppressed that the white stripe is generated on the print image due to the event that the conveyance amount is excessive and a clearance between the print images of each other printed by the respective scans is generated. In addition, it can be suppressed that the black stripe is generated on the print image due to the event that the conveyance amount is insufficient and the print images of each other printed by the respective scans excessively overlap. Therefore the conveyance by the appropriate conveyance amount is carried out to correspond to the landing range of the ink droplet, and the quality of the print image obtained by the printing can be highly maintained.

Next, a case of performing the printing in a head-medium distance C will be explained. The head-medium distance C is, as similar to the head-medium distance A, a head-medium distance for performing the printing of high image quality such as a photo or the like, and is different from the head-medium distance A in a point of setting a head-medium distance for preventing the friction or the like between a print head and a print medium. At the time of performing the printing in the head-medium distance C, the range of the ink droplet landing the print medium P is longer by 2C tan Y along the conveyance direction than the length X of the ejection port array in the conveyance direction. Therefore after the printing of the first line is completed, the print medium P is conveyed by the amount obtained by adding the conveyance amount 2C tan Y1 to the length X of the ejection port array by the conveying roller 8. Continuously the carriage 17 scans while ejecting ink droplets, thus completing the printing of the second line. After that, the print medium P is again conveyed by X+2C tan Y by the conveying roller 8. The printing operation and the conveying operation are repeated to perform the printing of all the print images, thus completing the printing process.

FIG. 7A and FIG. 7B are tables each showing a corrective amount for correcting the conveyance of a print medium for each kind of the print mediums. In FIG. 7A, a print medium 1 and a print medium 2 are photo papers which are respectively equivalent in thickness, a print medium 3 and a print medium 4 are plain papers which are respectively equivalent in thickness, a print medium 5 is an envelope, and a print medium 6 is a disc medium such as a CDR. In addition, the head-medium distances are set in a relation of A<B<C<D. In the present embodiment, since the head-medium distance is defined by a distance between an upper surface of the platen 14 and an ejection port forming surface of the print head 13, an actual distance between the print medium and the print head 13 changes with a change in thickness of the print medium. Therefore at the time of setting the head-medium distance C, the conveyance amount is corrected by adding a value such as 2C tan Y, 2C' tan Y1, or 2C" tan Y1 to the length X of the ejection port array corresponding to a change of the landing range in each of the print mediums 1 to 6. In this way, even if the distance between the ejection port forming portion of the print head 13 and the support surface of the platen 14 is equal, there are some cases where a distance between the ejection port forming portion of the print head 13 and a print surface of the print medium differs due to a difference in thickness of the print medium itself. In this case, the corrective amount at the time of the conveyance may be determined considering the thickness of the print medium itself to the distance between the ejection port forming portion of the print head 13 and the support surface of the platen 14.

In addition, FIG. 7B, as similar to FIG. 7A, is a table showing a corrective amount for correcting the conveyance of a print medium for each kind of the print mediums, but in the print mediums 3 and 4 only, the same corrective amount 2B tan Y1 is set as the conveyance amount regardless of the head-medium distance. Here, the print mediums 3 and 4 are plain papers. In a case of a print medium having properties that tend to generate bleeding, such as a plain paper, even if the landing range of an ink droplet changes more or less, degradation of the image quality due to it is not noticeable. Therefore in a case where printing is performed on the print medium having properties that tend to generate bleeding such as a plain paper, the corrective amount of the same conveyance may be set even if the head-medium distance changes.

In addition, there are some cases where the print medium slightly floats up from the support surface of the platen 14 depending on the position in the conveyance direction. Further, the print medium possibly drops into a rib formed on the upper surface of the platen 14 due to margin-less printing. Therefore in some cases a distance between only a partial region of the print medium and the ejection port forming portion in the print head partially changes.

For the adjustment to the change in the distance only in the partial region between the print medium and the ejection port forming portion in the print head, the setting of the corrective amount shown in each of FIG. 7A and FIG. 7B may be performed for each of the plurally divided regions of the print medium in the conveyance direction. In addition, the corrective amount may be set for each of the plurally divided regions of the print medium, and the correction of the conveyance amount of the print medium may be made based upon the set corrective amount.

In addition, the corrective amount of the conveyance shown in FIG. 7A and FIG. 7B may be further corrected based upon the deviation of the conveyance amount due to the print path number or a combination of the cumulative print media numbers. In this way, when the conveyance amount is corrected also in consideration of the other conditions, it is possible to set the conveyance amount more suitable for printing an image of high quality. Further, corrections in regard to a conveyance deviation due to the shape of the conveying roller 8, a conveyance deviation due to the kind of the print medium, a conveyance deviation due to the position of the print medium in the conveyance direction and the like may be added to the correction of the conveyance amount due to the difference in the head-medium distance. By doing so, the conveyance of the print medium can be carried out with higher accuracy to realize the printing of high image quality.

The corrective amount shown in FIG. 7A and FIG. 7B may be preferably set as a value per a unit length of the ejection port array along the conveyance direction to be capable of dealing with printing of various print path numbers. With such setting, the similar correction can be made for the conveyance of the print medium in each of the scans at the time of the printing by a plurality of path numbers. Therefore also at the time of the printing by a plurality of path numbers, the printing can be performed by the conveyance amount suitable for the printing of high image quality.

The corrective amount in the correction of the conveyance amount to be made based upon the difference in the head-medium distance is in advance stored in a conveyance control component 37 in a control substrate 38 mounted on the inkjet printing apparatus 1 shown in FIG. 8. In regard to timing of making the correction, when the kind of the print medium and the print mode are selected with using a printing apparatus driver on a personal computer as the host device 2000 and the setting of the head-medium distance is automatically performed, the corrective amount of the conveyance amount is set. The conveyance of the print medium in the process of the printing is controlled by the conveyance control component 37 using the corrected conveyance amount.

As described above, according to the present embodiment, by correcting the conveyance amount corresponding to the head-medium distance for printing, the print medium can be conveyed with the conveyance amount suitable for each of the head-medium distances to perform the printing. Therefore this correction of the conveyance amount can suppress generation of the white stripe on the print image due to the event that the conveyance amount is excessively large, and generation of the black stripe on the print image due to the event that the conveyance amount is insufficient and the print images of each other printed by the respective scans excessively overlap. Therefore it is possible to suppress degradation in the quality of the print image.

It should be noted that in the present embodiment, the ejection port formed near the outside end portion of the ejection port array formed in the print head 13 is inclined at an angle Y1 toward the outside in the direction perpendicular to the support surface of the platen 14. However, the present invention is not limited thereto, and the angle Y1 at which the ejection port formed near the outside end portion of the ejection port array is inclined in the direction perpendicular to the support surface of the platen 14 may be a minus value. That is, the ejection port formed near the outside end portion of the ejection port array may be inclined toward the inside of the ejection port array as to be directed to the inside of the ejection port array. In this case, the ejection port formed near the outside end portion of the ejection port array results in ejecting ink toward the inside of the ejection port array. At this time, since tan Y1 is a minus value, the corrective amount of the conveyance becomes a minus value. Accordingly, in this case, the correction of the conveyance amount of the print medium is made in such a direction that the conveyance amount is reduced. In addition, the angle Y1 includes a case of zero. In this case, since the tan Y1 is zero, the corrective amount for correction of the conveyance becomes zero.

Second Embodiment

Next, an inkjet printing apparatus according to a second embodiment of the present invention will be explained. It should be noted that components identical to those in the first embodiment are referred to as identical codes in the figures, the explanation is omitted, and different components only will be explained.

Figure 9:
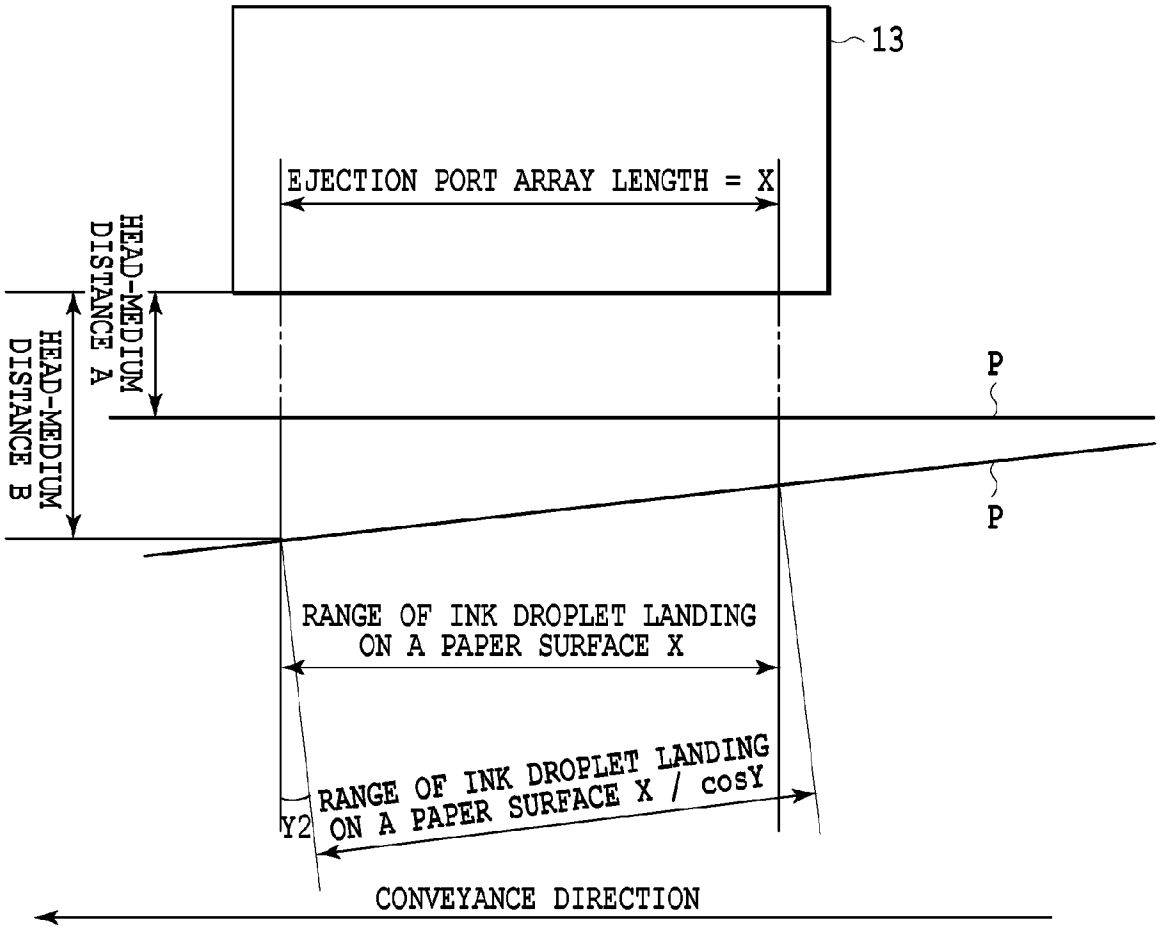
FIG. 9 is an explanatory diagram for explaining a distance between an ejection port forming portion in a print head and a print medium, and a landing range of an ink droplet changing with the distance.

FIG. 9 is a schematically side view for explaining a position relation between a print head in the inkjet printing apparatus and a print medium. The inkjet printing apparatus of the second embodiment includes a mechanism of rotating the carriage 17, on which the print head 13 is mounted, around the guide shaft 18 to change the head-medium distance. FIG. 9 shows a landing range of an ink droplet along the conveyance direction at the time the ink droplet ejected from the print head 13 having the ejection port array of the length X along the conveyance direction lands on the print medium, for each of the different head-medium distances.

Here, the ejection ports in the print head 13 are all formed in the same direction. That is, all the ejection ports formed in the print head 13 are formed to extend in the direction perpendicular to the surface of the ejection port forming portion. Further, FIG. 9 is illustrated in such a manner as to change the position of the print medium corresponding to the head-medium distance for explanation, but in an actual printing apparatus, the position of the print medium supported on the support surface of the platen 14 does not change. In the present embodiment, the carriage 17 is rotatably mounted around the guide shaft 18. The carriage 17 rotates around the guide shaft 18, and thereby the print head 13 rotates around the guide shaft 18 for movement. As a result, the print head 13 moves in an approaching/leaving direction relatively to the print medium.

First, a case of performing printing of high image quality on a print medium for a photo will be explained. For printing of higher image quality, the head-medium distance is set to a head-medium distance A having the smallest distance. At this time, the surface of the ejection port forming portion of the print head 13 has a parallel relation with the print medium. Therefore an ink droplet to be ejected from the ejection port array of the length X along the conveyance direction of the print medium lands on the print medium in the direction perpendicular thereto. As a result, the range in which the ink droplet lands on the print medium becomes X as it is.

Therefore in this case, the corrective amount for correction of the conveyance amount is zero. For the line feed operation, the print medium P is conveyed by the length X of the ejection port array by driving the conveying roller 8.

Next, similarly in regard to the print medium P for a photo, an explanation will be made of a case of performing printing in a head-medium distance B set as a head-medium distance for preventing pollution on the print medium due to a friction or the like between the print head and the print medium. In the present embodiment, by rotating the carriage 17 around the guide shaft 18, the head-medium distance is changed from A to B. That is, in the present embodiment, it is possible to adjust a distance between the ejection port forming portion in the print head 13 and the support surface in the platen 14 by adjusting an angle of the posture of the carriage 17 around the guide shaft 18. In the present embodiment, the CPU 1000 functions as an adjusting unit for adjusting the angle of the posture of the carriage 17 around the guide shaft 18 to adjust the distance between the ejection port forming portion in the print head 13 and the support surface in the platen 14. At this time, the carriage 17 is arranged at an angle (second inclination angle) to the support surface of the platen 14. That is, when the carriage 17 rotates around the guide shaft 18, the ejection port forming portion in the print head 13 mounted on the carriage 17 is arranged to be inclined to the print medium and the support surface of the platen 14. As a result, the distance between the ejection port forming portion in the print head 13 and the support surface of the print medium in the platen 14 becomes large. In addition, the direction of the ejection port in the print head 13 is inclined from a direction perpendicular to the print medium and the support surface of the platen 14. Therefore the surface on which the ejection port of the print head 13 is formed is not in parallel with the print medium. The ink droplet to be ejected from the ejection port is ejected to be inclined to the print medium.

Since the ink droplet lands on the print medium to be inclined thereto, the landing range of the ink droplet extends along the conveyance direction following it. At this time, the angle at which the ejection direction of the ink droplet is inclined to the print medium and the support surface of the platen 14 is set as an inclination angle Y2. At this time, as shown in FIG. 9, the landing range of the ink droplet to be ejected from the ejection port array of the length X along the conveyance direction on the print medium becomes X/cos Y2. That is, in a case where the print head 13 is inclined at the inclination angle Y2 to the print medium and the support surface of the platen 14, the ejected range of the ink droplet is longer by X ((1/cos Y2)−1) than the length X of the ejection port array. Therefore the conveyance amount is corrected corresponding to the extended amount of the landing range of the ink droplet in the conveyance direction.

In the present embodiment, the print medium P is conveyed by the amount obtained by adding the conveyance amount X ((1/cos Y2)−1) for correcting the landing deviation, to the length X of the ejection port array by the conveying roller 8. That is, the conveyance amount of the print medium is corrected to X/cos Y2. That is, the conveyance amount of the print medium is a conveyance corrective amount (second conveyance corrective amount) corrected by dividing the length X of the ejection port array along the conveyance direction by a cosine of the inclination angle Y2, and the conveyance of the print medium is controlled such that the conveyance of the print medium is carried out by the conveyance corrective amount. At this time, in the present embodiment, the CPU 1000 functions as a control unit for controlling the conveyance amount of the print medium. That is, as the corrected conveyance amount is indicated at H2, H2=X/cos Y2.

In this way, the conveyance amount of the print medium is adjusted corresponding to the changing amount by which the landing range of the ink droplet changes, thus controlling the conveyance. This control of the conveyance can suppress the event that the excessively overlapped portion between the print images of each other printed by the respective scans becomes large, and thereby the black stripe is generated on the print image. In addition, since generation of a clearance between the print images of each other printed by the respective scans can be suppressed, generation of the white stripe on the print image can be suppressed. Since generation of the black stripe or the white stripe can be thus suppressed, the quality of the print image to be obtained by the printing can be highly maintained.

It should be noted that the second embodiment adopts the print head in which the ejection ports in the ejection port array all extend in the direction perpendicular to the ejection port forming portion, but the present invention is not limited thereto. The print head 13, as explained in the first embodiment, in which the ejection ports extend to gradually change the inclination angles of the ejection ports from the center ejection port to the outside ejection port in the ejection port array, may be used. In this case, the conveyance amount may be set based upon both of the corrective amount of the conveyance by the posture of the print head and the corrective amount of the conveyance by the inclination of the ejection port.

Other Embodiment

It should be noted that the explanation is made of the aforementioned embodiment in which the printing is performed on the predetermined print region by the single scan of the print head, but the present invention is not limited thereto. The present invention may adopt multi-path printing in which the printing is performed on the predetermined print region by a plurality of scans of the print head. In a case of performing the multi-path printing in which the printing is performed on the predetermined print region by a plurality of scans of the print head, the conveyance amount per one scan differs depending upon the number of times of scans for the printing on the predetermined region. Also in a case of performing the printing by the multi-path printing, the present invention may be applied. In a case of performing the multi-path printing, the correction of the conveyance amount by the present invention may be made to the conveyance amount at each conveyance to control the conveyance.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-106982, filed May 8, 2012, which is hereby incorporated by reference herein in its entirety.

What is claimed is:

1. An inkjet printing apparatus comprising:

a carriage configured to mount a print head and move along a first direction, the print head including an ejection port forming portion in which ejections ports through which ink droplets are ejected are formed;

a conveying unit configured to convey a print medium along a second direction intersecting with the first direction;

a support surface for supporting a print medium conveyed by the conveying unit;

a control unit configured to perform a printing operation in which an image is printed by electing ink droplets by the print head with movement of the carriage along the first direction and an intermittent conveyance operation in which the print medium is intermittently conveyed by a conveyance amount along the second direction by the conveying unit;

a change unit which is capable of changing a distance between the ejection port forming portion and the support surface; and a correction unit configured to correct the conveyance amount in the intermittent conveyance operation based on the distance changed by the change unit.

2. An inkjet printing apparatus according to claim 1, wherein the print head ejects the ink droplets in a direction inclined from a direction perpendicular to the support surface in at least a portion of the ejection ports.

3. An inkjet printing apparatus according to claim 2, wherein the print head includes an ejection port array formed therein in which a plurality of the ejection ports are formed along the second direction, the ejection port formed in a position close to a center portion of the ejection port array in the second direction ejects the ink droplets in a direction closer to the direction perpendicular to the support surface, and the ejection port formed in a position closer to an outside end portion of the ejection port array in the second direction ejects the ink droplets in a direction more inclined from the direction perpendicular to the support surface.

4. An inkjet printing apparatus according to claim 3, wherein among the ejection ports forming the ejection port array, the ink droplets to be ejected from the ejection port formed closer to the outside end portion in the second direction is ejected in a direction having an inclination angle from the direction perpendicular to the support surface, and the correction units corrects the conveyance amount of the print medium by the conveying unit in such a manner as to perform the conveyance of the print medium by a conveyance corrective amount corrected by adding twice a value obtained by multiplying a distance between the ejection port forming portion and the support surface by a tangent of the inclination angle, to the length of the ejection port array in the second direction.

5. An inkjet printing apparatus according to claim 4, wherein if the inclination angle is Y1, the length of the ejection port array in the second direction is X, the distance between the ejection port forming portion and the support surface is L, and the conveyance amount corrected by the correction unit is H1, then $$H1=X+(2\times L\times \tan Y1).$$

6. An inkjet printing apparatus according to claim 1, further comprising:

a guide shaft extending along the first direction, wherein the carriage slides on the guide shaft to be guided to move in the first direction, and is mounted to be rotated around the guide shaft, and the change unit is able to the change the distance between the ejection port forming portion and the support surface by changing an angle of a posture of the carriage around the guide shaft.

7. An inkjet printing apparatus according to claim 6, wherein the print head includes an ejection port array formed therein in which a plurality of the ejection ports are formed along the second direction, the carriage is arranged at an inclination angle to the support surface, and the correction unit corrects the conveyance of the print medium by the conveying unit in such a manner as to carry out the conveyance of the print medium by a conveyance corrective amount corrected by dividing the length of the ejection port array along the second direction by a cosine of the inclination angle.

8. An inkjet printing apparatus according to claim 7, wherein if the inclination angle is Y2, the length of the ejection port array in the second direction is indicated at X, and the conveyance amount corrected by the correction unit is H2, then $$H2=X/\cos Y2.$$

9. An inkjet printing apparatus according to claim 1, wherein the correction unit corrects the conveyance amount of the print medium by the conveying unit for each of plurally divided regions of the print medium in the second direction.

10. An inkjet printing apparatus according to claim 1, wherein the correction unit corrects the conveyance amount of the print medium by the conveying unit in such a manner as to further correct at least one of a deviation of the conveyance amount by a print path number, a deviation of the conveyance amount by a cumulative print median number, and a deviation of the conveyance amount by a kind of the print medium.

* * * * *